US008419144B2

(12) United States Patent
Castillo et al.

(10) Patent No.: US 8,419,144 B2
(45) Date of Patent: Apr. 16, 2013

(54) MEDIA HANDLING DEVICE FOR A PRINTER

(75) Inventors: Ruddy Castillo, Briarwood, NY (US); Barry Paul Mandel, Fairport, NY (US); Lloyd A. Williams, Mahopac, NY (US); James L. Giacobbi, Penfield, NY (US); Frank A. Porter, Penfield, NY (US); Joannes DeJong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 325 days.

(21) Appl. No.: 12/777,777

(22) Filed: May 11, 2010

(65) Prior Publication Data

US 2011/0279507 A1 Nov. 17, 2011

(51) Int. Cl.
*B41J 25/308* (2006.01)

(52) U.S. Cl.
USPC ..... 347/8; 347/16; 347/19

(58) Field of Classification Search ..... 347/5, 8, 347/19, 9, 16; 356/429
See application file for complete search history.

(56) References Cited

U.S. PATENT DOCUMENTS

| | | | | |
|---|---|---|---|---|
| 5,805,291 | A * | 9/1998 | Calvin et al. | 356/429 |
| 6,625,561 | B1 | 9/2003 | Tullis | |
| 6,929,417 | B2 | 8/2005 | Boudreau | |
| 2004/0008230 | A1 * | 1/2004 | Kelley et al. | 347/8 |
| 2004/0233244 | A1 * | 11/2004 | Elgee et al. | 347/19 |
| 2008/0238959 | A1 * | 10/2008 | Kato et al. | 347/8 |
| 2009/0110411 | A1 | 4/2009 | Gungor et al. | |

* cited by examiner

*Primary Examiner* — Lam S Nguyen
(74) *Attorney, Agent, or Firm* — Maginot, Moore & Beck, LLP

(57) ABSTRACT

An inkjet printing system includes a sensor positioned proximate a media transport path in an inkjet printing system, the sensor being configured to detect a media height exceeding a predetermined height with reference to the media transport path, and a controller associated with the inkjet printing system, the controller being configured to modify operation of the inkjet printing system in response to the sensor detecting a media height exceeding the predetermined height.

9 Claims, 6 Drawing Sheets

MEDIA HANDLING DEVICE FOR A PRINTER

TECHNICAL FIELD

The process and device described below relate to inkjet imaging devices and, more particularly, inkjet imaging devices that print onto media.

BACKGROUND

Drop on demand inkjet technology for producing printed images has been employed in products such as printers, multifunction products, plotters, and facsimile machines. Generally, an inkjet image is formed by selectively ejecting ink drops from a plurality of drop generators or inkjets, which are arranged in a printhead, onto an image receiving substrate. For example, the image receiving substrate may be moved relative to the printhead and the inkjets may be controlled to emit ink drops through nozzles formed in the printhead at appropriate times. The timing of the inkjet activation is performed by a printhead controller, which generates firing signals that activate the inkjets to eject ink. The ink ejected from the inkjets is liquid ink, such as aqueous, solvent, oil based, curable ink, or the like, which is stored in containers installed in the printer. Alternatively, the ink may be loaded in a solid or a gel form and delivered to a melting device, which heats the ink to generate liquid ink that is supplied to a printhead.

The ejected ink travels through an air gap between the printhead face and the image receiving substrate. The greater the distance between the printhead face and the image receiving member, the greater the force required for the expulsion of the ink to travel this distance and land on the substrate at the position intended for the ejected ink drops. Additionally, a larger air gap enables particulate matter to flow between the printhead face and the substrate. This particulate matter may land on the printhead face and interfere with printhead nozzles or ink drops ejected from the inkjet nozzles.

Inkjet printers that print images on precut sheets of print media are referred to as cut sheet inkjet printers. Cut sheet inkjet printers strip media sheets from a supply of media sheets stacked on an input tray. A media conveyer transports each stripped media sheet through a print zone of the printer. The inkjets eject ink onto the print media as the media conveyer transports the print media through the print zone. After receiving ink from the inkjets, the media conveyer transports the stripped media sheet to an output tray. Once received by the output tray the media sheets are collected by a user or received by another printing system for further processing.

The media conveyer transports the media sheets through the print zone where the printheads are operated to eject ink onto a surface of the media sheets. Accordingly, an air gap is required that is large enough to enable sheets of different thicknesses to pass by the printheads without requiring the inkjet ejectors to expend large amounts of energy to propel the ink drops across the air gap. These competing restrictions on the air gap between the printheads and the media sheets can be balanced provided the media sheets stripped from the input tray are flat and free from creases or other imperfections. Some media sheets stripped from the input tray, however, may include creases and other imperfections. As the media conveyer transports these media sheets, the imperfect portions of the media sheet may pass through the print zone at a distance too close to the printheads for accurate placement of the ink drops. Consequently, image quality may be affected by the close passage of the media sheets to the printhead. For example, some nozzles in the printhead may become clogged by particulate matter carried by a media sheet and image streaks and/or missing pixels may be produced in the printed image. Therefore, control of the distance between media surfaces and the printhead faces in the print zone is useful.

SUMMARY

An inkjet printing system enables media having a height that may pass too close to a printhead to be detected and processed appropriately. The inkjet printing system includes a sensor positioned proximate a media transport path in an inkjet printing system, the sensor being configured to detect a media height exceeding a predetermined height with reference to the media transport path, and a controller associated with the inkjet printing system, the controller being configured to modify operation of the inkjet printing system in response to the sensor detecting a media height exceeding the predetermined height.

A method for operating an inkjet printing system enables media having a height that may pass too close to a printhead to be detected and processed appropriately. The method includes detecting with a sensor a media exceeding a predetermined height with reference to a media transport path on which media moves through an inkjet printing system, and modifying operation of the inkjet printing system with a controller associated with the inkjet printing system in response to the sensor detecting a media height exceeding the predetermined height.

BRIEF DESCRIPTION OF THE FIGURES

The foregoing aspects and other features of the present disclosure are explained in the following description, taken in connection with the accompanying drawings.

DETAILED DESCRIPTION

The apparatus and method described herein make reference to a printing system. The term "printing system" refers, for example, to reproduction devices in general, such as printers, facsimile machines, copiers, and related multi-function products. While the specification focuses on an inkjet printing system, the apparatus and method described herein may be used with any printing system that forms an image on an image receiving surface, including, but not limited to, xerographic, laser, and aqueous printing systems.

Figure 1:
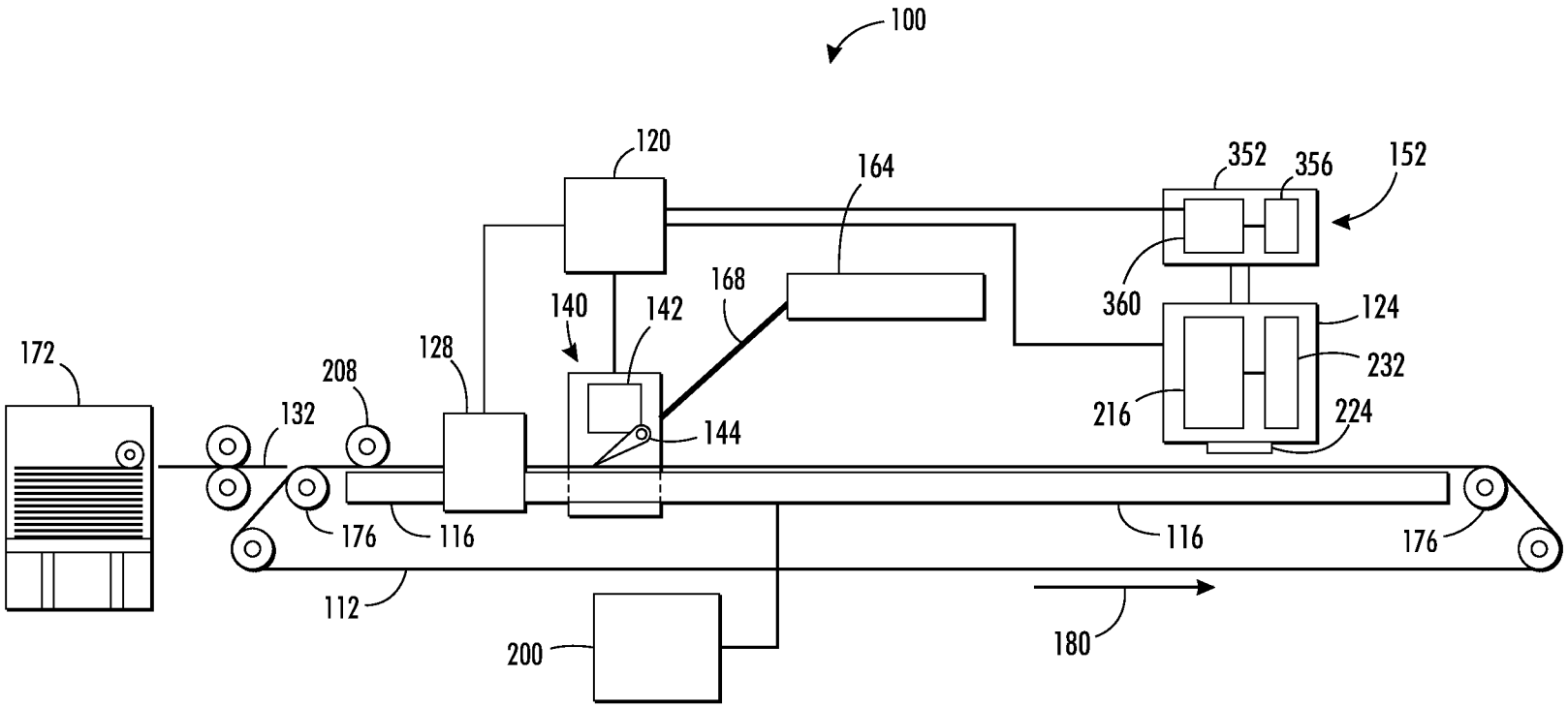
FIG. 1 depicts a block diagram of an inkjet printing system, as disclosed herein, the printing system is configured to prevent media sheets from contacting the printheads of a printhead assembly.

As shown in FIG. 1, an inkjet printing system 100 prints images on print media 132. The printing system 100 detects the print media 132 having a profile that is unsuitable for receiving ink. Specifically, the printing system 100 detects the media 132 having a media height exceeding a predetermined height (distance 272 of FIG. 2). The printing system 100 prevents the detected media 132, referred to herein as nonconforming media, from undesirably affecting the print quality of images printed subsequent to the detection of the nonconforming media 132.

The printing system 100 of FIG. 1 includes input rollers 108, a transport belt 112, a guide surface 116, a controller 120, a printhead assembly 124, and a sensor apparatus 128. The input rollers 108 are coupled to a printer support frame (not illustrated) to propel the media 132 onto the transport belt 112. The transport belt 112 receives the media from the input rollers 108 and transports the media 132 past the sensor apparatus 128. The controller 120 receives an electronic signal from the sensor apparatus 128 in response to the sensor apparatus 128 detecting a media 132 which has a height in excess of the predetermined height, referred to as a nonconforming media. To prevent the nonconforming media 132 from contacting a printhead 224 of the printhead assembly 124, the controller 120 modifies an operation of the printing system 100 by initializing one or more of an active gate 140 and a positioning device 152. The active gate 140 diverts the nonconforming media 132 to a purge tray 164 via a media transport 168. The positioning device 152 moves the printhead assembly 124 to prevent the nonconforming media 132 from contacting a printhead 224.

The input rollers 108 form a nip that propels the media 132 onto the transport belt 112. The printing system 100 of FIG. 1 is configured to receive pre-cut sheets of print media 132, and may be referred to as a "cut sheet" printer. The input rollers 108, shown in FIG. 1, receive the media 132 from a media sheet stripping device 172 that strips individual media sheets from a supply of media sheets. Alternatively, the input rollers 108 may receive the media 132 from another component of the printing system 100, such as a duplex path for double-sided printing. At least one of the input rollers 108 is coupled to a source of rotation.

The transport belt 112 transports the media 132 propelled by the input rollers 108. The transport belt 112 may be porous such that air may be drawn from a top side of the belt to a bottom side of the belt, as may be used with, for example, a vacuum-type media transport system. Alternatively, however, the belt 112 may be non-porous, as may be used with, for example, an electrostatic-type media transport system. Numerous rollers 176 support the transport belt 112 such that the transport belt 112 forms a loop. At least one of the rollers 176 that supports the transport belt 112 is connected to a source of rotation to drive the transport belt around the loop, as is known in the art. The transport belt 112 transports the media along a media transport path, which is defined by the upper portion of the loop defined by the transport belt 112. The media transport path extends in a process direction 180 from the input rollers 108 to the printhead assembly 124.

The guide surface 116 is positioned within the loop of a transport belt 112, such that the transport belt slides across the upper surface of a guide surface and the media transport path is generally linear. The guide surface 116 may be a plenum connected to a negative pressure source 200. The plenum includes numerous openings though which the negative pressure source 200 draws air. Air drawn through the plenum pulls the transport belt 112 and any media sheet 132 carried by the transport belt towards the plenum. Drawing the media 132 against the transport belt 112 helps to ensure that the media 132 is transported flat against the transport belt. Even in response to the airflow of the negative pressure source 200, portions of some media 132 received by the transport belts 112 may remain above the predetermined height.

The media transport 168 is configured to transport media 132 from the active gate 140 to the purge tray 164. To this end, the media transport 168 may include one or more transport belts and guide surfaces, which extend from the active gate 140 to the purge tray 164. Alternatively, however, the media transport 168 may be formed from any suitable media transport devices, known to those of ordinary skill in the art.

As shown in FIG. 1, the printing system 100 includes a roller 208 positioned to contact the transport belt 112. The roller 208 is coupled to the support frame and is configured to rotate in response to the movement of the transport belt 112. The roller 208 presses the media 132 against the transport belt 112 and presses the transport belt 112 against the guide surface 116. The roller 208 enables most media 132 received by the transport belt 112 to flatten and remain entirely below the predetermined height. Nonetheless, some media 132 pressed by the rollers 208 may include portions that remain above the predetermined height.

The printhead assembly 124 ejects ink onto the media 132 to form a printed image on the media. The printhead assembly 124 includes a reservoir 216, a printhead 224, and a heater 232. The reservoir 216 contains a quantity of liquid ink. The reservoir 216 may be filled directly by a user with liquid ink, or the reservoir 216 may be coupled to an ink supply (not illustrated) that is configured to supply the reservoir with liquid ink. The ink in the reservoir 216 flows to the printhead 224. The heater 232 is thermally coupled to the reservoir 216 to maintain liquid ink within the reservoir in a state suitable for ejection onto the media 132. The heater 232 may be deactivated or removed in embodiments of the printing system 100 configured to print images with an ink composition that remains in the liquid phase at room temperature.

Figure 2:
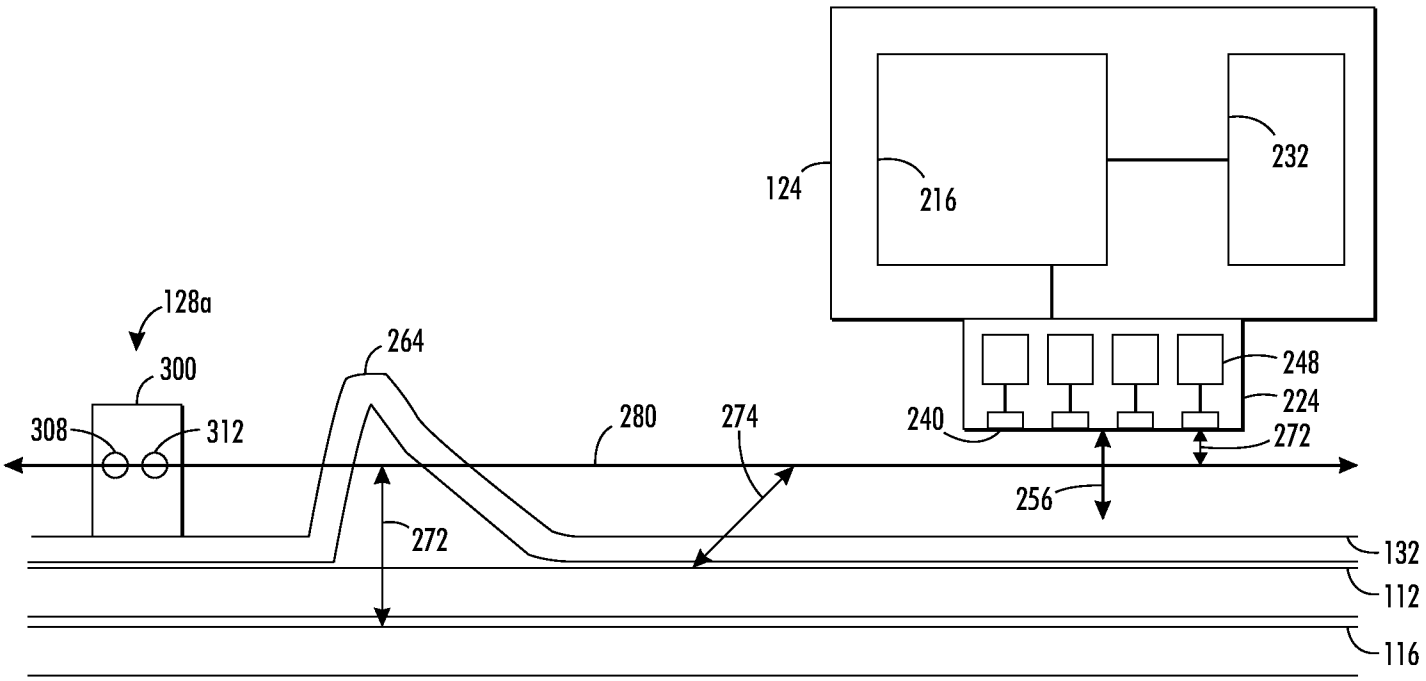
FIG. 2 is a block diagram of a media sheet positioned on a transport belt of the printing system of FIG. 1, a portion of the media sheet exceeds a predetermined height.

As shown in FIG. 2, the printhead 224 includes nozzles 240 and inkjet ejectors 248. Also shown in FIG. 2 is a portion of the sensor apparatus 128*a* and a media sheet 132 having an imperfection 264, both of which are described below. The nozzles 240 and inkjet ejectors 248 are shown in FIG. 2 in an enlarged and simplified form. The nozzles 240 are very small openings in the bottom of the printhead 224. A nozzle 240 may have a diameter or width of approximately twenty micrometers (20 μm) to thirty micrometers (30 μm). The printhead 224 may include between five hundred to eight hundred nozzles 240 positioned within an approximately rectangular region. An inkjet ejector 248 is fluidly coupled to each nozzle 240 and electrically coupled to the controller 120 (FIG. 1) to receive firing signals. In response to receiving a firing signal, an inkjet ejector 248 ejects a droplet of liquid ink through a corresponding nozzle 240. The inkjet ejectors 248 may be thermal inkjet ejectors or piezoelectric inkjet ejectors, as is known in the art.

The printhead assembly 124 of FIG. 1 ejects ink onto the media 132 as the media is transported under the printhead 224 by the transport belt 112. In general, the media 132 remains a distance, referred to as an air gap 256 (FIG. 2), from the printhead 224 as the transport belt 112 transports the media under the printhead 224. The gap 256 has a length of approximately three hundred micrometers (300 μm) to twelve hundred micrometers (1200 μm). Accordingly, the media 132 passes under the printhead 224, but does not contact the printhead 224 during the printing process. The media having irregularities, such as the crease 264, may contact the nozzles 240 and disrupt the flow of ink droplets from the printhead 224. The disruption of the flow of ink droplets from the printhead 224 is undesirable.

The predetermined height is a height threshold; accordingly, the media 132 residing entirely below the predetermined height are suitable to receive ink from the printhead 224. The media 132 having any portion that extends above the predetermined height are not suitable to receive ink from the printhead 224. In FIG. 2, the predetermined height may be measured as a distance 272 extending from the surface of the transport belt 112 to a plane 280. The plane 280 is parallel with the surface of the transport belt 112 and the lower surface of the printhead 224. Alternatively, the predetermined height may be measured from the upper surface of the guide surface 116 to the plane 280, or the predetermined height may be measured from the upper surface of the media 132 to the plane 280. The predetermined height may also be measured from the printhead 224 to the plane 280, in which case the predetermined height may be described as a minimum distance between the media 132 and the printhead 224. In each case, the media 132 having any portion that resides above the plane 280 exceeds the predetermined height, and in each case the media 132 having any portion residing closer to the printhead 224 than the gap 256 exceeds the predetermined height. As shown by the position of the plane 280, portions of some media may exceed the predetermined height yet not contact the printhead 224. These media portions are still capable of disrupting the path of the ink ejected towards the media. Furthermore, depending on the direction of measurement, the predetermined height may not be an absolute height. An absolute height, as the term is used herein, is measured perpendicularly from at least one reference point, as shown by the distance 272 in which the first reference point is the guide surface 116 and the second reference point is the plane 280. A non-absolute height extends from at least one reference point in a non-perpendicular direction, as shown by distance 274 in which the first reference point is the transport belt 112 and the second reference point is the plane 280.

Figure 3:
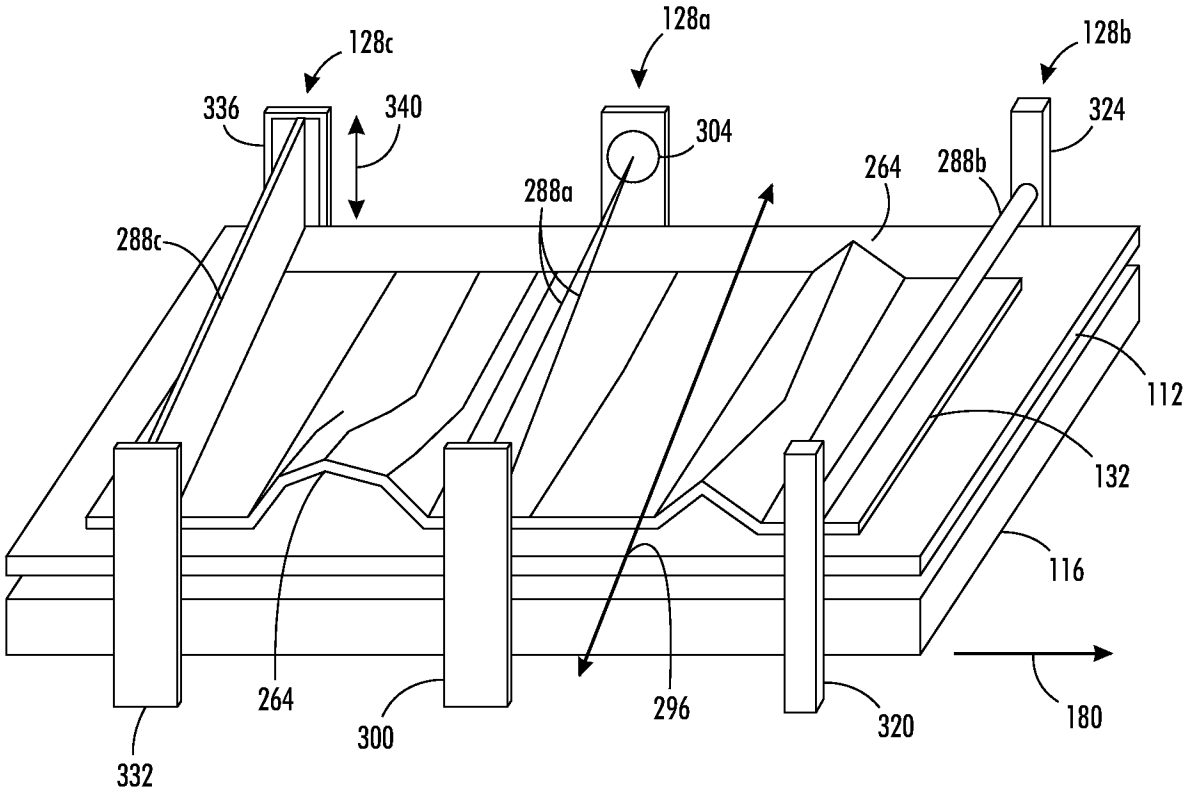
FIG. 3 is a perspective view of three different sensor apparatus, each of which being configured for use with the printing system of FIG. 1.

As shown in FIG. 3, the printing system 100 may include one or more sensor apparatus 128*a*, 128*b*, 128*c*, each of which is configured to detect imperfections 264 in the media 132 by emitting a corresponding optical beam 288*a*, 288*b*, 288*c* across the transport belt 112. The sensor apparatus 128*a*, 128*b*, 128*c* is electrically coupled to the controller 120 (FIG. 1). Additionally, the sensor apparatus 128*a*, 128*b*, 128*c* is positioned prior to the printhead assembly 124 as measured in the process direction 180. The sensor apparatus 128*a*, 128*b*, 128*c* generates an electrical signal in response to detecting a portion of the media in excess of the predetermined height. The electrical signal is received by the controller 120.

Figure 5:
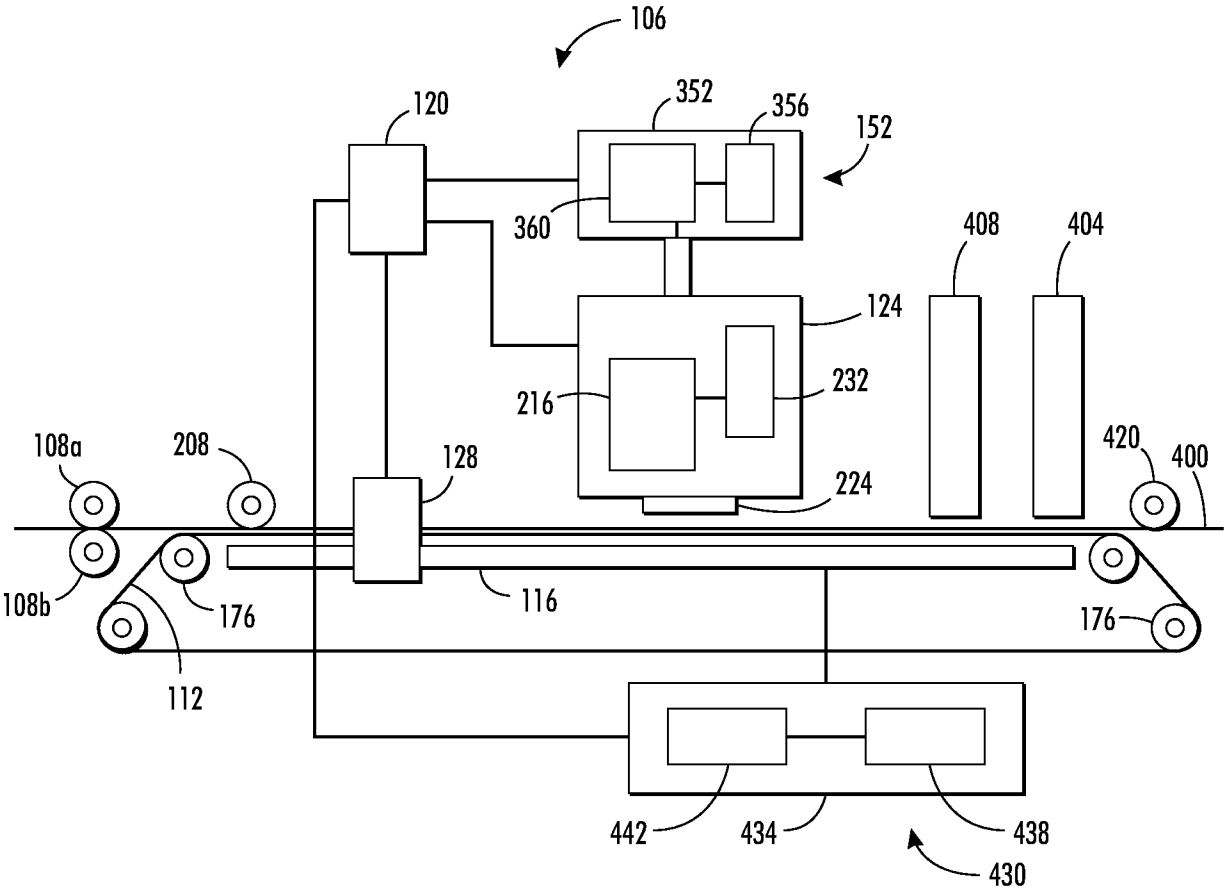
FIG. 5 is a block diagram of an alternative embodiment of the printing system of FIG. 1, the printing system being configured to print images on a continuous web of print media.

The sensor apparatus 128*a* includes a transmitter/receiver 300 and a reflector 304. As shown in FIG. 2, a transmitter 308 of the transmitter/receiver 300 is positioned to emit an optical beam 288*a* (FIG. 3) across the transport belt 112 in a cross process direction 296. The cross process direction 296 is perpendicular to the process direction 180 and in the plane defined by the surface of the transport belt 112. The transmitter 308 emits the optical beam 288*a* toward the reflector 304. A receiver 312 (FIG. 2) of the transmitter/receiver 300 receives the reflection of the optical beam 288*a* from the reflector 304. The transmitter 308 emits the optical beam 288*a* at the predetermined height. If each portion of the media 132 resides below the predetermined height, the beam 288*a* emitted by the transmitter 308 extends across the media, reflects off the reflector 304, and is received by the receiver 312. In other words, the beam 288*a* is not broken or blocked by the media 132 when the media resides entirely below the predetermined height. If, however, any portion of the media 132 resides above the predetermined height, the media obstructs the path of the beam 288*a*, thereby preventing the receiver 312 from receiving the beam 288*a*. The sensor apparatus 128*a* may generate a print signal in response to receiving the beam 288*a*, and may generate a fault signal in response to the media 132 breaking the beam 288*a*. The sensor apparatus 128*a* may generate the fault signal in response to the media 132 completely blocking the beam 288*a* from being received by the receiver 312. The sensor apparatus 128*a* may detect the height of cut sheet print media and continuous print media, such as a continuous web 400 (FIG. 5)

As shown in FIG. 3, the sensor apparatus 128*b* includes a transmitter 320 and a receiver 324. The sensor apparatus 128*b* works similarly to the sensor apparatus 128*a* except that the transmitter 320 and receiver 324 are separate units. The transmitter 320 emits the beam 288*b* in the cross process direction 296, and the receiver 324 is positioned across the media 132 and the transport belt 112 to receive the beam 288*b*. The sensor apparatus 128*b* may generate the print signal in response to receiving the beam 288*b*, and may generate the fault signal in response to the media 132 breaking the beam 288*b*. The sensor apparatus 128*b* may detect the height of cut sheet print media and continuous print media in the manner noted above with reference to the sensor apparatus 128*a*.

The sensor apparatus 128*c* includes a transmitter 332 and a receiver 336. The sensor apparatus 128*c* functions similarly to the sensor apparatus 128*b* except that the optical beam 288*c* is broader. As shown in FIG. 3, the width 340 extends from approximately the surface of the transport belt 112 upward continuously to at least the predetermined height. The sensor apparatus 128*c* may be referred to as a "curtain" type sensor or a "sheet" type sensor because the beam 288*c* emitted by the transmitter 332 has a measurable area. The sensor apparatus 128*c* may generate a variable electronic signal, referred to as a height signal. A magnitude of the height signal is related to the height of the media that is positioned in the beam 288*c*. The sensor apparatus 128*c* may compare the height signal to a threshold height signal that is equal to the predetermined height to determine if the media exceeds the predetermined height. Additionally or alternatively, the height signal may be transmitted to the controller 120, which determines if the measured height is above or below the predetermined height. The sensor apparatus 128*c* may detect the height of cut sheet print media and continuous print media.

Each sensor apparatus 128*a*, 128*b*, 128*c* "scans" the entire media for imperfections. The entire width of the media is scanned because each optical beam 288*a*, 288*b*, 288*c* extends across the width of the media. The entire length of the media is scanned because the entire sheet passes by the sensor apparatus 128*a*, 128*b*, 128*c* in the process direction 180.

As shown in FIG. 1, the sensor apparatus 128 is positioned proximate to the media transport path. Alternatively, the sensor apparatus 128 may be mounted to the printhead assembly 124. In particular, some printhead assemblies may be moved vertically to adjust the gap 256 for a particular thickness of media. A comparatively thin media may require the printhead 224 to move closer to transport belt 112, and a comparatively thick media may require the printhead 224 to move farther from the transport belt 112. By associating the sensor apparatus 128 (both the transmitter and receiver or the transmitter/receiver and reflector) with the printhead assembly 124, such that the sensor apparatus 128 moves with the printhead assembly 128, the optical beam 288*a*, 288*b* (FIG. 3) may be positioned a fixed distance from the printhead 224 regardless of the position of the printhead 224 relative to the transport belt 112 and the media 132 transported on the transport belt 112. Similarly, by connecting the sensor apparatus 128*c* to the printhead assembly 124, the optical beam 288*c* (FIG. 3) emitted by the sensor apparatus 128*c* may originate a fixed distance from the printhead 224 and terminate a fixed distance from the printhead 224 regardless of the position of the printhead 224 relative to the transport belt 112 and the media transported on the transport belt 112.

As shown in FIG. 1, the controller 120 receives the signals generated by the sensor apparatus 128 to determine if the media 132 should be transported to the printhead 224 or if the media should be prevented from contacting the printhead 224. The controller 120 is configured with I/O circuitry, memory, programmed instructions, and other electronic components to process electronic data representative of an image. The controller 120 processes image data to generate a sequence of firing signals, which are sent to the printhead assembly 124. The firing signals cause the inkjet ejectors 248 in the printhead 224 to eject ink droplets onto the media 132 in a configuration that forms the image corresponding to the image data. Additionally, the controller 120 processes the signals generated by the sensor apparatus 128.

In response to receiving the print signal from the sensor apparatus 128, the controller 120 generates firing signals that cause the printhead 224 to eject ink onto the media 132. Generation of the print signal indicates that the media 132 transported by the transport belt 112 has a media height less than the predetermined height. A media with a height less than the predetermined height receives ink from the printhead assembly 124 without contacting the printhead 224. In response to receiving the fault signal from the sensor apparatus 128, or any other signal that indicates that a portion of the media 132 exceeds the predetermined height, the controller 120 prevents the nonconforming media from contacting the printhead 224.

As shown in FIG. 1, the printing system 100 may prevent nonconforming media 132 from contacting the printhead 224 by removing the nonconforming media from the transport belt 112 with the active gate 140. The active gate 140 is mounted to the support frame of the printing system 100 along the media transport path and includes a motor module 142 and a gate 144. The motor module 142 is electrically coupled to the controller 120. The gate 144 extends across at least a portion of the transport belt 112 in the cross process direction 296. The gate 144 is connected to the motor module 142 and is configured to pivot between an inactive position and an active position. In the inactive position, as shown by the gate 144 of FIG. 1, the gate 144 is positioned away from the transport belt 112 to enable the media 132 to be transported under the gate 144 on the transport belt 112. In the active position, as shown by the gate 144*a* of FIG. 4, a leading edge of the gate 144 contacts the transport belt 112, such that a media sheet 132 transported past the active gate 140 contacts the gate 144 and is removed from the transport belt 112. In particular, the leading edge of the gate 144 is inserted between the media sheet 132 and the transport belt 112 to separate and to remove the media sheet from the transport belt, as is known in the art.

The active gate 140 receives an electronic signal from the controller 120 that causes the motor unit 142 to pivot the gate 144. Specifically, in response to the sensor apparatus 128 detecting that the media 132 is below the predetermined height, the controller 120 sends an electronic signal to the active gate 140, which cause the gate 144 to be positioned in the inactive position. Alternatively, when the sensor apparatus 128 detects that a portion of the media 132 is above the predetermined height, the controller 120 sends an electronic signal to the active gate 140 that causes the motor module 142 to position the gate 144 in the active position. Specifically, when the sensor apparatus 128 detects a nonconforming media sheet 132, the gate 144 enters the active position before any portion of the media sheets passes the gate, to enable the active gate 140 to remove the nonconforming media from the transport belt 112 and to prevent the nonconforming media from contacting the printhead 224. The nonconforming media 132 removed from the transport belt 112 is transported on the media transport 168 to the purge tray 164. The controller 120 prevents the printhead assembly 124 from ejecting ink directly onto the transport belt 112 when a media sheet 132 has been removed from the transport belt 112.

The controller 120 may cause the active gate 140 to pivot the gate 144 to the active position for a predetermined time period, which enables the active gate to remove only a single nonconforming media 132 from the transport belt 112 without removing or interfering with any conforming media 132. Alternatively, depending on the speed of the transport belt 112, among other factors, the active gate 140 may remove one or more conforming media sheets 132 along with each nonconforming media sheet removed from the transport belt 112.

As shown in FIG. 1, the printing system 100 may also prevent nonconforming media 132 from contacting the printhead 224 by moving the printhead assembly 124 with a positioning device 152. The positioning device 152 includes a frame 352, a motor 356, and a transmission 360. The frame 352 is mounted to a printer support frame of the printing system 100. The motor 356 is mounted to the frame 352 and is mechanically coupled to the printhead assembly 124 through the transmission 360. The motor 356 is also electrically coupled to the controller 120. Rotation of a drive shaft (not illustrated) by the motor 356 is transferred by the transmission 360 to the printhead assembly 124 to move the printhead assembly 124 relative to the transport belt 112.

In response to the sensor apparatus 128 detecting that a portion of the media exceeds the predetermined height, the controller 120 sends a signal to the positioning device 152 that causes the positioning device 152 to move the printhead assembly 124 away from the transport belt 112. As shown in FIG. 1, moving the printhead assembly 124 away from the transport belt 112 increases the gap 256 and allows the media 132 to pass under the printhead 224 without contacting the printhead. The ejection of ink onto the media stops when the printhead assembly 124 is moved away from the transport belt 112. In response to the sensor apparatus 128 indicating that the media 132 currently being scanned resides below the predetermined height, the controller 120 activates the positioning device 152 to move the printhead assembly 124 toward the transport belt 112, such that the printhead 224 is separated from the media by the gap 256. Printing may resume after the printhead assembly 124 has been repositioned.

In response to detecting a portion of the media 132 exceeds the predetermined height, the controller 120 may stop the flow of media through the printing system 100. In particular, the rotation of the transport belt 112 and the flow of media sheets from the media stripping device 172 is stopped in response to the sensor apparatus 128 detecting that the media exceeds the predetermined height. The printhead assembly 124 stops ejecting ink when the media 132 is stopped. After the controller 120 stops the media, the media 132 having an imperfection 264 may be removed by a user. Printing may continue after the nonconforming media 132 has been removed. The printing system 100 of FIG. 1 may perform any one or more of the above described processes and actions in response to detecting that a media sheet 132 has a height in excess of the predetermined height. For example, the printing system 100 may raise the printhead 224 with the positioning device 152 and/or divert the media 132 to the purge tray 164 with the active gate 140. Alternatively, the printing system 100 may raise the printhead assembly 124 and stop the media.

Figure 4:
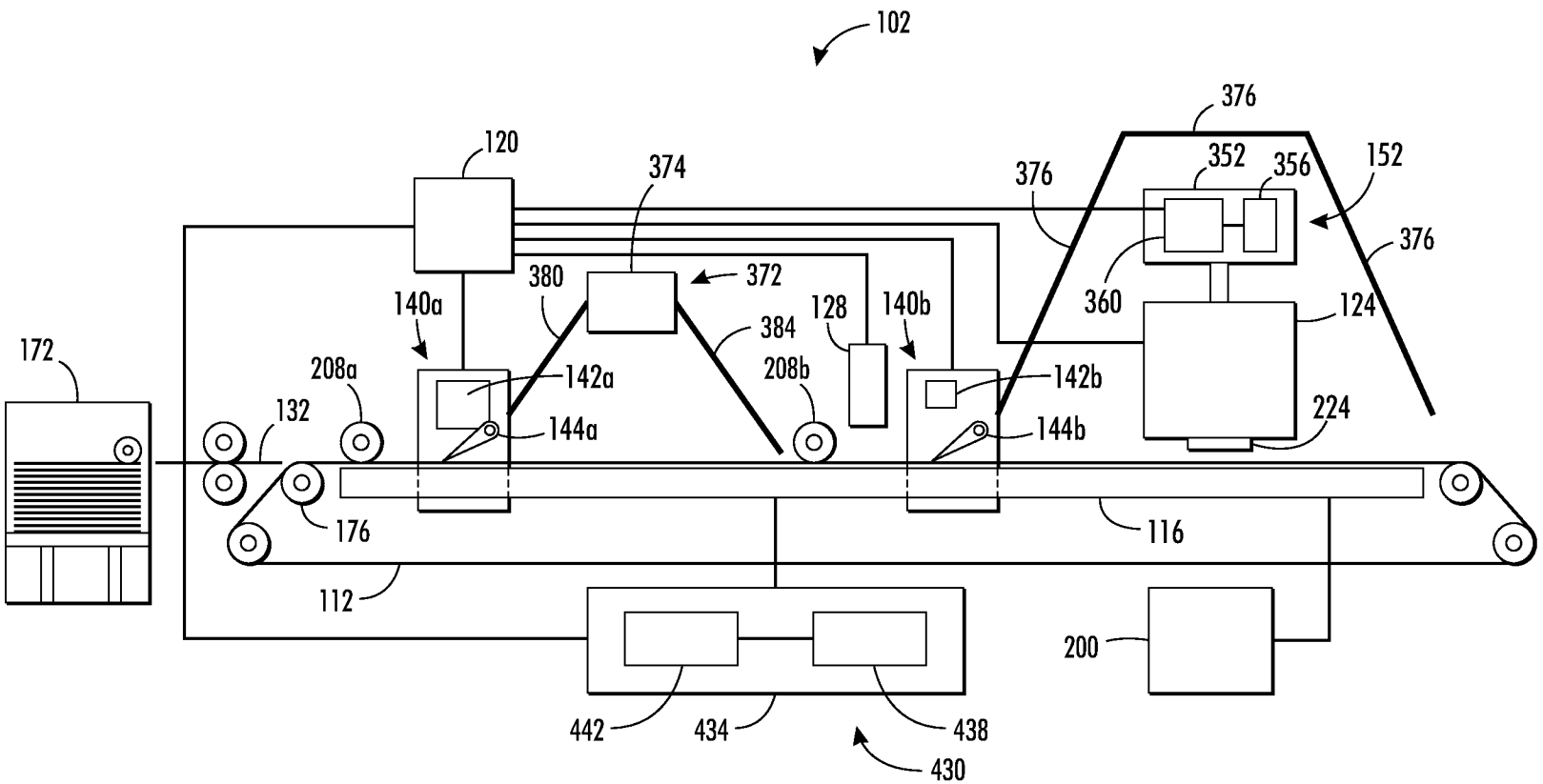
FIG. 4 is a block diagram of an alternative embodiment of the inkjet printing system of FIG. 1, the printing system including a bypass and a buffer.

As shown in FIG. 4, a printing system 102, similar to the printing system 100, includes a buffer 372, a bypass media transport 376, an active gate 140*a*, an active gate 140*b*, and a positioning device 430. The bypass media transport 376 may include one or more transport belts and guide surfaces configured to transport the media 132. Alternatively, the bypass media transport 376 may be formed from any suitable media transport devices, known to those of ordinary skill in the art. The bypass media transport 376 defines an alternative media transport path, which does not extend under the printhead 224. As shown in FIG. 4, the bypass media transport 376 merges with the media transport path defined by the transport belt 112 at a point subsequent to the printhead assembly 124. Although the bypass media transport 376 is shown extending above the printhead assembly 124 and the positioning device 152, the media transport 376 may extend in any other direction so long as the media 132 transported on the media transport 376 does not contact the printhead 224.

In response to the sensor apparatus 128 detecting a nonconforming media sheet, the controller 120 may cause the active gate 140*b* to remove the nonconforming media sheet from the transport belt 112. The bypass media transport 376 transports the nonconforming media sheet removed from the transport belt 112 by the active gate 140*b* past the printhead assembly 124. In response to the sensor apparatus 128 detecting media 132 that resides entirely below the predetermined height, the active gate 140*b* positions the gate 144*b* in the inactive position to enable the conforming media to receive ink from the printhead 224.

The buffer 372 includes a media tray 374, a media transport 380, and a media transport 384. The media transport 380 receives the media 132 from the active gate 140*a* and transports the media to the media tray 374. The media transport 384 receives the media 132 from the media tray 374 and transports the media to the transport belt 112. The media transports 380, 384 may include one or more transport belts and guide surfaces to form a media path. Alternatively, however, the media transport 380, 384 may be formed from any suitable media transport devices, known to those of ordinary skill in the art.

The buffer 372 receives conforming media sheets 132 at least during the time period required to prevent a nonconforming media sheet detected by the sensor apparatus 128 from contacting the printhead assembly 124. For example, in response, to the controller 120 causing the active gate 140*b* to divert a nonconforming media sheet to the bypass media transport 376, the controller 120 may also cause the active gate 140*a* to divert conforming media sheets received by the transport belt 112 to the media tray 374 until the nonconforming media sheet(s) is prevented from contacting the printhead 224. Accordingly, the flow of media 132 from the stripping device 172 may remain constant when the sensor apparatus 128 detects a nonconforming media. After the nonconforming the media sheet 132 has been cleared from the printhead assembly 124 the media 132 in the media tray 374 may be transported to the transport belt 112 via the media transport 384. For example, the printing system 102 may include a media sheet stripper (not illustrated) associated with the media tray 374 that withdraws media sheets from the media tray 374 and reintroduces the media 132 to the media transport path defined by the transport belt 112. The media 132 reintroduced to the transport belt 112 by the media transport 384 is pressed against the transport belt 112 by the roller 208*a* and is scanned by the sensor apparatus 128 to ensure that each portion of the media stripped from the media tray 374 is below the predetermined height.

As shown in FIG. 4, the printing system 102 includes a positioning device 430 configured to prevent nonconforming media 132 from contacting the printhead 224 by moving the media transport path defined by the transport belt 112. The positioning device 430 includes a frame 434, a motor 438, and a transmission 442. The frame 434 is mounted to the printer support frame (not illustrated) of the printing system 102. The motor 438 is mounted to the frame 434 and may be mechanically coupled to the guide surface 116 and/or at least one of the rollers 176 through the transmission 442. As shown in the block diagram of FIG. 4, the positioning device 430 is mechanically coupled to the guide surface 116. The motor 438 is also electrically coupled to the controller 120. The transmission 360 transmits rotation of a drive shaft (not illustrated) by the motor 356 to the guide surface 116 and/or at least one of the rollers 176 to move the media transport relative to the printhead assembly 124. For example, the positioning device 430, as illustrated in FIG. 4, may move the media transport path by lowering the guide surface 116. In other embodiments, the positioning device 430 may move the media transport path by lowering the guide surface 116 and the rollers 176. Lowering the guide surface 116 includes lowering the entire guide surface as well as pivoting the guide surface to lower a region of the guide surface proximate to the printhead 224.

In response to the sensor apparatus 128 detecting that a portion of the media exceeds the predetermined height, the controller 120 sends a signal to the positioning device 430 that causes the positioning device 430 to move the media transport path away from the transport belt 112. As shown in FIG. 2, moving the media transport path (the upper surface of the transport belt 112) away from the printhead 224 increases the gap 256 and allows the media 132 to pass under the printhead 224 without contacting the printhead. The ejection of ink onto the media 132 stops when the media transport path is moved away from the printhead 224. In response to the sensor apparatus 128 indicating that the media 132 currently being scanned resides below the predetermined height, the controller 120 activates the positioning device 430 to move the media transport path toward the printhead 224, such that the printhead 224 is separated from the media 132 by the gap 256. Printing may resume after the media transport path has been repositioned.

The printing system 102 may perform any one or more of the above described processes in response to detecting a nonconforming media sheet. For example, the printing system 102 may raise the printhead 224 with the positioning device 152, direct conforming media 132 to the buffer 372, and divert nonconforming media past the printhead assembly 124 on the bypass media transport 376. Additionally or alternatively, the printing system 102 may stop the flow of media sheets from the stripping device 172 (and the media tray 374) to enable a user to remove a nonconforming media sheet from the media transport path. Additionally or alternatively, the printing system 102 may move the media transport path with the positioning device 430 to enable a nonconforming media sheet 132 to pass the printhead 224 without contacting the printhead.

As shown in FIG. 5, a printing system 106 similar to the printing system 100, prints images on a continuous web 400 of print media 132. The printing system 106 includes the continuous web 400, an ink curing device 404, and an ink leveling device 408. The continuous web of print media is a strip or web of print media 132 that is drawn through the printing system 106 on the media transport path. The printing system 106 prevents portions of the continuous web 400 that exceed the predetermined height from contacting the printhead 224.

Nonconforming portions of the continuous web 400 are not removed from the media transport path with an active gate. Instead, in response to the sensor apparatus 128 detecting an imperfection 264 in the continuous web 400, the controller 120 may activate the positioning device 152 to move the printhead assembly 124 away from the transport belt 112 and the continuous web 400. Additionally or alternatively, in response to detecting an imperfection 264 in the continuous web 400, the controller 120 may activate the positioning device 430 to move the transport belt 112 and the continuous web 400 away from the printhead assembly 124. The increased distance between the printhead 224 and the continuous web 400 enables the imperfect portion of the continuous web 400 to pass under the printhead 224 without contacting the printhead. The ejection of ink onto the continuous web 400 stops when the printhead assembly 124 is moved away from the continuous web. In response to the sensor apparatus 128 indicating that each portion of the continuous web resides below the predetermined height, the controller 120 activates the positioning device 152 to move the printhead assembly 124 toward the continuous web 400, such that the printhead 224 is separated from the continuous web by the gap 256. Printing may resume after the printhead assembly 124 has been repositioned.

Additionally, in response to the detection of media that exceeds the predetermined height, the controller 120 of the printing system 106 may stop the rotation of the transport belt 112 in order to stop the movement of the continuous web 400 through the printing system 106. The nonconforming portion of the continuous web 400 may then be removed from the system 106 and a user may then route the remaining portion of the continuous web through the media transport path. The printhead assembly 124 stops ejecting ink when the controller 120 stops the continuous web.

Figure 6:
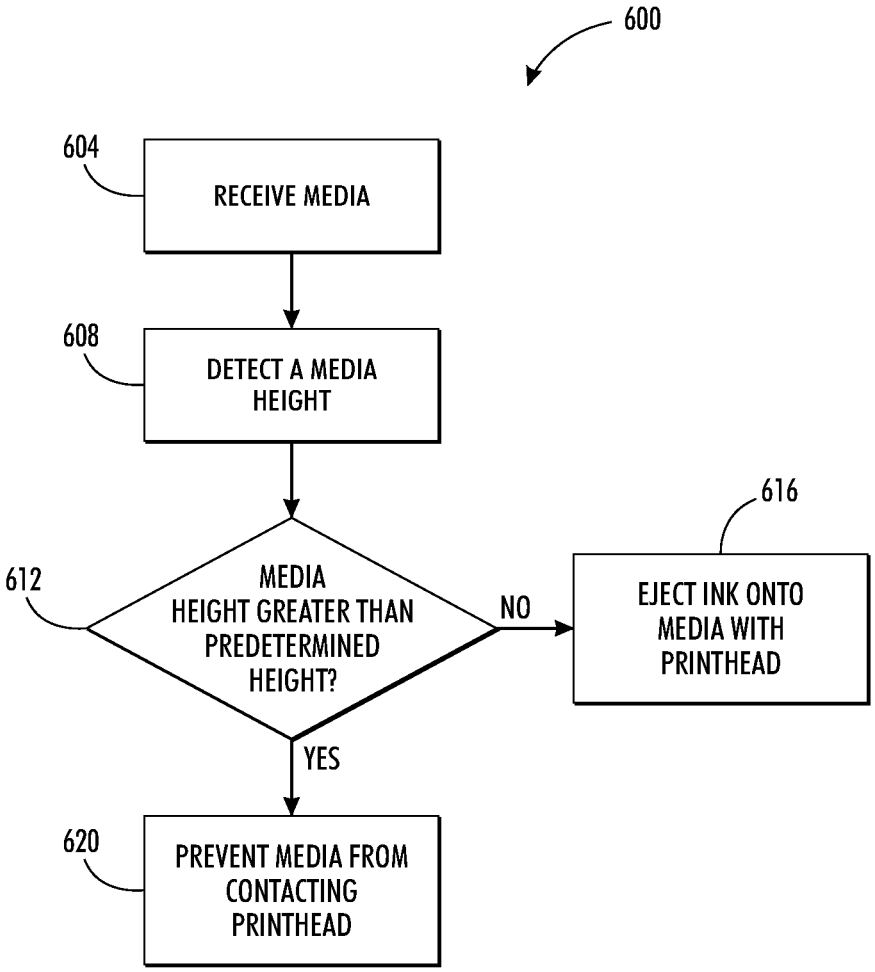
FIG. 6 is a flowchart depicting an exemplary process of operating each printing system of the present disclosure.

The printing system 102 of FIG. 4 may be operated according to the process 600 illustrated by the flowchart of FIG. 6. First, the printing system 102 receives media from a media supply (block 604). The roller 208*a* presses the media 132 against the transport belt 112 to seat the media against the transport belt. Next, with the gate 144*a* in the inactive position, the transport belt 112 transports the media 132 past the active gate 140*a*. Subsequently, the roller 208*b*, presses against the media 132 against the transport belt 112. Thereafter, the transport belt 112 transports the media 132 past the sensor apparatus 128. The sensor apparatus 128 emits the beam 288*a*, 288*b*, or 288*c* (FIG. 3) across the media 132 to determine if any portion of the media is positioned above the predetermined height (block 608). If the media 132 is entirely below the predetermined height, the media is transported past the active gate 140*b* to the printhead assembly 124 to receive ink from the printhead 224 (blocks 612, 616). If the sensor apparatus 128 detects that any portion of the media 132 is above the predetermined height; however, the controller 120 modifies operation of the printing system 102 to prevent the nonconforming media from contacting the printhead 224 (blocks 612, 620).

The controller 120 modifies operation of the printing system 102 by activating one or more of the following devices. The controller 120 may activate the active gate 140*b* to direct the nonconforming media sheet to the bypass media transport 376. Additionally or alternatively, the controller 120 may activate the positioning device 152 to lift the printhead 224 away from the transport belt 112. When any one or more of the above operations are occurring, the controller 120 may activate the active gate 140*b* to divert conforming media sheets 132 to the buffer 372 until the nonconforming media is purged from the printing system 102. Additionally or alternatively, the controller 120 may stop the flow of media 132 through the printing system 102 to enable a user to remove the nonconforming media. Additionally or alternatively, the controller 120 may activate the positioning device 430 to move the media transport path relative to the printhead 224. After the printing system 102 prevents the nonconforming media 132 from contacting the printhead 224, the printing system 102 resumes printing images on the conforming media.

The printing system 100, 102, 106 prints images on print media 132 with one of numerous ink compositions. Exemplary ink compositions include, but are not limited to, phase change inks, gel based inks, curable inks, aqueous inks, and solvent inks. As used herein, the term "ink composition" encompasses all colors of a particular ink composition including, but not limited to, usable color sets of an ink composition. For example, an ink composition may refer to a usable color set of phase change ink that includes cyan, magenta, yellow, and black inks. Therefore, as defined herein, cyan phase change ink and magenta phase change ink are different ink colors of the same ink composition.

The term "phase change ink", also referred to as "solid ink", encompasses inks that remain in a solid phase at an ambient temperature and that melt to a liquid phase when heated above a threshold temperature, referred to in some instances as a melt temperature. The ambient temperature is the temperature of the air surrounding the printing system 100, 102, 106; however, the ambient temperature may be a room temperature when the printing system 100, 102, 106 is positioned in an enclosed or otherwise defined space. The ambient temperature may fluctuate at various positions along the transport belts 112. An exemplary range of melt temperatures for phase change ink is approximately seventy degrees (70°) to one hundred forty degrees (140°) Celsius; however, the melt temperature of some phase change inks may be above or below the exemplary melt temperature range. When phase change ink cools below the melt temperature the ink returns to the solid phase. The printhead assembly 124 ejects phase change ink in the liquid phase onto the media 132. Liquid ink phase change ejected onto to a media 132 becomes affixed to the media 132 in response to the ink cooling below the melt temperature.

The terms "gel ink" and "gel based ink", as used herein, encompass inks that remain in a gelatinous state at the ambient temperature and that may be heated or otherwise altered to have a different viscosity suitable for ejection onto the media 132 by the printhead assembly 124. Gel ink in the gelatinous state may have a viscosity between $10^5$ and $10^7$ centipoise ("cP"); however, the viscosity of gel ink may be reduced to a liquid-like viscosity by heating the ink above a threshold temperature, referred to as a gelation temperature. An exemplary range of gelation temperatures is approximately thirty degrees (30°) to fifty (50°) degrees Celsius; however, the gelation temperature of some gel inks may be above or below the exemplary gelation temperature range. The viscosity of gel ink increases when the ink cools below the gelation temperature. Some gel inks ejected onto the media sheet become affixed to the media sheet in response to the ink cooling below the gelation temperature.

Some ink compositions, referred to herein as curable inks, are cured by the printing system 100, 102, 106. As used herein, the process of "curing" ink refers to curable compounds in an ink undergoing an increase in molecular weight in response to being exposed to radiation. Exemplary processes for increasing the molecular weight of a curable compound include, but are not limited to, crosslinking and chain lengthening. Cured ink is suitable for document distribution, is resistant to smudging, and may be handled by a user. Radiation suitable to cure ink may encompass the full frequency (or wavelength) spectrum including, but not limited to, microwaves, infrared, visible, ultraviolet, and x-rays. In particular, ultraviolet-curable gel ink, referred to herein as UV gel ink, becomes cured after being exposed to ultraviolet radiation. As used herein, the term "ultraviolet" radiation encompasses radiation having a wavelength from approximately fifty nanometers (50 nm) to approximately five hundred nanometers (500 nm).

As shown in FIG. 5, the printing system 106 includes a curing assembly 404 and a leveling device 408. The curing assembly 404 may be mounted to the support frame subsequent to the printhead assembly 124 to cure the ink ejected onto the print media by the printhead assembly 124. The curing assembly 404 may also be coupled to other portions of the support frame configured for selective mounting of a printing system component such as the curing assembly 404. The curing assembly 404 is positioned along the media transport path to cure the ink ejected onto the continuous web 400 before the ejected ink contacts any of a series of rollers (for example, the roller 420), which guide the web along the media path. The curing assembly 404 may expose the ink to ultraviolet radiation to cure the ink. The curing assembly 404 may be mounted to the printing systems 100, 102 to cure curable ink ejected onto cut sheets of print media.

The ink leveling device 408 is configured to spread ink droplets ejected onto the print media into a substantially continuous area without physically contacting the ink droplets. When ink droplets contact the print media there may be a space between each ink droplet and a plurality of surrounding ink droplets. The ink leveling device 408 flattens the ink droplets such that each ink droplet contacts one or more adjacent ink droplets to form a continuous area of ink. The ink leveling device 408 is commonly used to spread gel ink; however, the ink leveling device is not limited to spreading only gel ink. The ink leveling device 408 may expose the ink to infrared radiation to spread the ink without contacting the ink. The ink leveling device 408 may be mounted to the printing system 100, 102 to spread ink droplets ejected onto cut sheets of print media.

The printer system 100, 102, 104 has been described as a simplex printing system in which an image is formed on only one side of the print media. The printing system 100, 102, 104, however, may also be a duplex printing system in which an image is formed on both sides of a print media. The sensor apparatus 128 detects print media having a portion that exceeds the predetermined height independent of whether the printhead assembly 124 is ejecting ink on the first side or the second side of the print media.

Those of ordinary skill in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An inkjet printing system, comprising:

an optical sensor positioned proximate a media transport path in an inkjet printing system, the optical sensor including:

a single optical beam emitter positioned proximate the media transport path, the single optical beam emitter being configured to emit in a cross-process direction across the media transport path an optical sheet;

a single optical beam receiver positioned proximate the media transport path to receive the optical sheet emitted by the optical beam emitter, the single optical beam receiver being configured to generate a signal corresponding to a height of media on the media transport path in response to the optical beam receiver being blocked from receiving at least a portion of the optical beam by the media;

a controller associated with the inkjet printing system, the controller being configured to receive the signal generated by the single optical beam receiver and determine the height of the media on the media transport path, the controller being further configured to modify operation of the inkjet printing system with reference to the height of the media; and a printhead configured to be moved with reference to the media transport path, wherein the controller being further configured to operate the printhead to move the printhead to enable media having the media height that exceeds the predetermined height to pass the printhead, and wherein the single optical beam emitter and the single optical beam receiver move with the printhead.

2. The inkjet printing system of claim 1, the controller being further configured to divert media having a media height that exceeds a predetermined height.

3. The inkjet printing system of claim 1, the controller being further configured to stop media having a media height that exceeds a predetermined height from moving along the media transport.

4. The inkjet printing system of claim 3, the controller being further configured to divert other media following media having a media height that exceeds the predetermined height to a second media transport path.

5. The inkjet printing system of claim 1, further comprising:

a printhead associated with the media transport path; and the controller being further configured to operate the media transport path to move the media transport path to enable media having a height that exceeds a predetermined height to pass the printhead.

6. A method of operating an inkjet printing system comprising:

emitting an optical sheet with a single optical beam emitter, the single optical beam emitter being positioned proximate the media transport path to enable the optical sheet to be emitted in a cross-process direction across media moving on a media transport path;

receiving at least a portion of the optical sheet with a single optical beam receiver and generating with the optical beam receiver a signal corresponding to a height of the media moving on the media transport path, the single optical beam receiver being positioned proximate the media transport path;

determining with a controller a height of the media with reference to the signal generated by the single optical beam receiver;

modifying operation of the inkjet printing system with a controller associated with the inkjet printing system in response to the controller determining a height of the media exceeds a predetermined height; and moving a printhead to enable media having a height that exceeds the predetermined height to pass the printhead, the printhead being associated with the media transport path, and the movement of the printhead increases a distance between the printhead and the media transport path, wherein the single optical beam emitter and the single optical beam receiver move with the printhead.

7. The method of operating an inkjet printing system of claim 6, the modification of the inkjet printing system operation further comprising:

diverting media having a height that exceeds the predetermined height from the media transport path in response to the controller determining the height of the media exceeds the predetermined height.

8. The method of operating an inkjet printing system of claim 6, the modification of the inkjet printing system operation further comprising:

stopping media having a height determined by the controller to exceed the predetermined height from moving along the media transport.

9. The method of operating an inkjet printing system of claim 6, the modification of the inkjet printing system operation further comprising:

moving the media transport path to enable media having a height determined by the controller to exceed the predetermined height to pass a printhead, the printhead being associated with the media transport path, and the movement of the media transport path being with reference to the printhead.

* * * * *